US005174737A

United States Patent [19]

Sakata et al.

[11] Patent Number: 5,174,737

[45] Date of Patent: Dec. 29, 1992

[54] FLUID COMPRESSOR WITH SPIRAL BLADE

[75] Inventors: Hirotsugu Sakata, Chigasaki; Tsugio Itami, Numazu; Masayuki Okuda, Yokohama; Takuya Hirayama, Fujisawa; Satoru Oikawa, Fuji, all of Japan

[73] Assignee: Kabushiki Kaisha Toshiba, Kawasaki, Japan

[21] Appl. No.: 721,753

[22] Filed: Jun. 27, 1991

[30] Foreign Application Priority Data

Jun. 28, 1990 [JP] Japan ..... 2-168529

[51] Int. Cl.[5] ..... F04C 18/22; F04C 29/00

[52] U.S. Cl. ..... 418/55.1; 418/220

[58] Field of Search ..... 418/55.1, 56, 153, 156, 418/220

[56] References Cited

U.S. PATENT DOCUMENTS

| | | | |
|---|---|---|---|
| 2,358,721 | 9/1944 | Ljungdahl | 418/55.1 |
| 2,401,189 | 5/1946 | Quiroz . | |
| 2,764,101 | 9/1956 | Rand | 418/55.1 |
| 3,274,944 | 9/1966 | Parsons | 418/55.1 |
| 4,871,304 | 10/1989 | Lida et al. | 418/220 |

FOREIGN PATENT DOCUMENTS 0301273 2/1989 European Pat. Off. .

*Primary Examiner*—John J. Vrablik

*Attorney, Agent, or Firm*—Foley & Lardner

[57] ABSTRACT

Disclosed is a fluid compressor which comprises a closed case having an inlet for a fluid at one end thereof and an outlet for a fluid at the other, a cylinder fixed in the case, and a rotary member which orbits in and relatively to the cylinder, wherein the rotary member has a compression unit for compressing a fluid supplied into the closed case from the inlet thereof on the orbit movement of the rotary member, then discharging it outside from the outlet of the closed case.

5 Claims, 5 Drawing Sheets

FLUID COMPRESSOR WITH SPIRAL BLADE

BACKGROUND OF THE INVENTION

1. Field of the Invention

The present invention relates to a fluid compressor suitable, for example, for compressing a refrigerant gas in the refrigeration cycle.

2. Description of the Prior Art

As compressors generally known so far, there can be mentioned reciprocal or rotary type compressors. Moreover, a helical-blade type fluid compressor is also well known. The fluid compressor of this type, as described in Japanese Patent Application No. 62-191564 for example, is so constructed that a refrigerant is applied into an operation chamber on the inlet side of a cylinder, then carried in the cylinder toward another operation chamber on the outlet side of the cylinder while being successively compressed, and is thereafter discharged from the cylinder.

For example, as shown in FIG. 1, the helical blade type compressor includes driving means 105 comprising a stator 101 fixed to an outer frame of the compressor and a rotor 103 rotatable in the stator 101, a cylinder 107 integrally joined to the rotor 103, and a rotary rod 111 which is orbited by means of an Oldham ring 109 rotatable about an eccentric axis spaced by a distance e apart from the central axis of the cylinder 107. Namely, all of these roter 103, cylinder 107 and rotary rod 111 are rotated to the stator 101, so that the rotary rod 111 is helically orbited to the cylinder 107. Moreover, a spiral groove 113 is formed in the outer surface of the rotary rod 111 over almost all of the lateral length thereof, and a blade 115 is detachably fitted in the groove 113. Besides, the outer surface of the blade 115 is partly in contact with the inner surface of the cylinder 107 so that the blade 115 rotates together with the cylinder 107.

Because the rotary rod 111 is helically orbited about the eccentric axis shifted by a distance e from the central axis of cylinder 107, the rotation speed of the cylinder 107 differs from that of the rotary rod 111, and the difference is changed at a cycle of one rotation of the rod 111. Moreover, since the blade 115 flexibly moves along the groove 113 during the rotation, the space defined between the rotary rod 111 and the cylinder 107 are divided by the blade 115 so as to form a plurality of operation chambers 117. Therefore, each capacity of the operation chambers is determined by the pitch of the spiral groove 113 in which is fitted the blade 115 upon a determination of an inside diameter of the cylinder and an outside diameter of the roter.

Incidentally, the pitch of the groove 113 is gradually reduced from one end to the other of the rotary rod 111. Namely, according to the construction shown in FIG. 1, since the capacity of each operation chamber 117 formed by the blade 115 is gradually reduced toward the discharging side of the cylinder 111, corresponding to an outlet pipe 121, from the inlet side thereof, corresponding to a suction pipe 119, a refrigerant supplied from the inlet side is successively carried toward the discharging side through the plurality of operation chambers 117 while being gradually compressed.

Thus, according to the above-mentioned helical blade type fluid compressor, the refrigerant compression efficiency is decided by the ratio between capacities of the operation chamber nearest to the inlet and the chamber nearest to the outlet. Therefore, one means for enhancing the efficiency of the compressor is to enlarge the capacity of the operation chamber, which is nearest to the inlet. That is, the first operation chamber 117. Moreover, to enlarge the capacity of the first chamber 117, as shown in FIG. 2, it is necessary to either enlarge the first pitch P of the spiral groove 113 on the inlet side (shown on the right side in the same drawing) to make larger the diameter of the cylinder 107, or to make smaller the diameter of the rotary rod 111.

However, if the first pitch P of the spiral groove 113 is enlarged, the torsion stress imposed on the blade 115, around the area corresponding to the pitch P, will be so large that the blade 115 is likely to be fatigued. As the result, it is very difficult to guarantee the durability of the blade 115 and to prevent its breakage.

On the other hand, if the diameter of the cylinder 107 is enlarged, the inner diameter of the rotor 103 must be increased, such that efficiency of the motor is degraded, and the weight of the cylinder 107 and rotary rod 111 is increased. In particular, in this case, since the load of the rotor 103 to be imposed on a bearing section 123 is increased, the bearing section 123 is likely to be damaged, such that it is very difficult to stably support rotor 103 at its right and left side with a high degree of accuracy during assembly of the compressor. Moreover, since the stator 101 and rotor 103 must be enlarged with the enlargement the cylinder 107, it is necessary to increase the dimensions of the entire system. Additionally, an increase of the relative speed between the bearing section 123 and the cylinder 107 in proportion to the enlargement in diameter of the cylinder results in an increase of the driving loss of the compressor. When the diameter of the piston become smaller, since the eccentric value becomes large, the amount of the blade which must be inserted into the piston is increased. Therefore, it is difficult to make the rotor smaller.

SUMMARY OF THE INVENTION

The present invention was made to solve the above-mentioned problem in the conventional art.

Therefore, it is an object of the present invention to provide a fluid compressor in which the diameter of the cylinder can be increased while suppressing the loss to be imposed on the bearing section.

To achieve the object, the fluid compressor according to the present invention comprises a closed case having an inlet at one end thereof and an outlet at the other, a cylinder fixed in the closed case, a rotary member which is fitted around an eccentric shaft, the central axis being spaced by a predetermined distance apart from the central axis of a main shaft inserted in the cylinder, and orbits in contact with the inner surface of the cylinder at a part of the outer surface thereof, a spiral groove which is formed in the outer surface of the rotary member and has a pitch being gradually narrower toward the outlet side of the closed case from the inlet side thereof, a spiral blade which is movably fitted in the groove and contacts with the inner surface of the cylinder at a part of the outer surface thereof so as to divide the space defined between the inner surface of the cylinder and the outer surface of the rotary member into a plurality of operation chambers, and driving means for giving rotational driving force to the main shaft.

According to such a fluid compressor, since the cylinder is fixed in the closed case, the load related to the cylinder does not act on a bearing section which supports the main shaft. Therefore, it becomes possible to enlarge the diameter of the cylinder without causing any damage to the bearing section, so that the capacity of each operation chamber, particularly of the operation chamber nearest to the inlet of the case, can be enlarged. As the result, the operation efficiency can be greatly improved.

These and other objects, features and advantages of the present invention will be more apparent from the following description of a preferred embodiment, taken in conjunction with the accompanying drawings.

DETAILED DESCRIPTION OF THE EMBODIMENTS

Hereinafter, one embodiment of the present invention will be described with reference to FIGS. 3 to 8.

Figure 1:
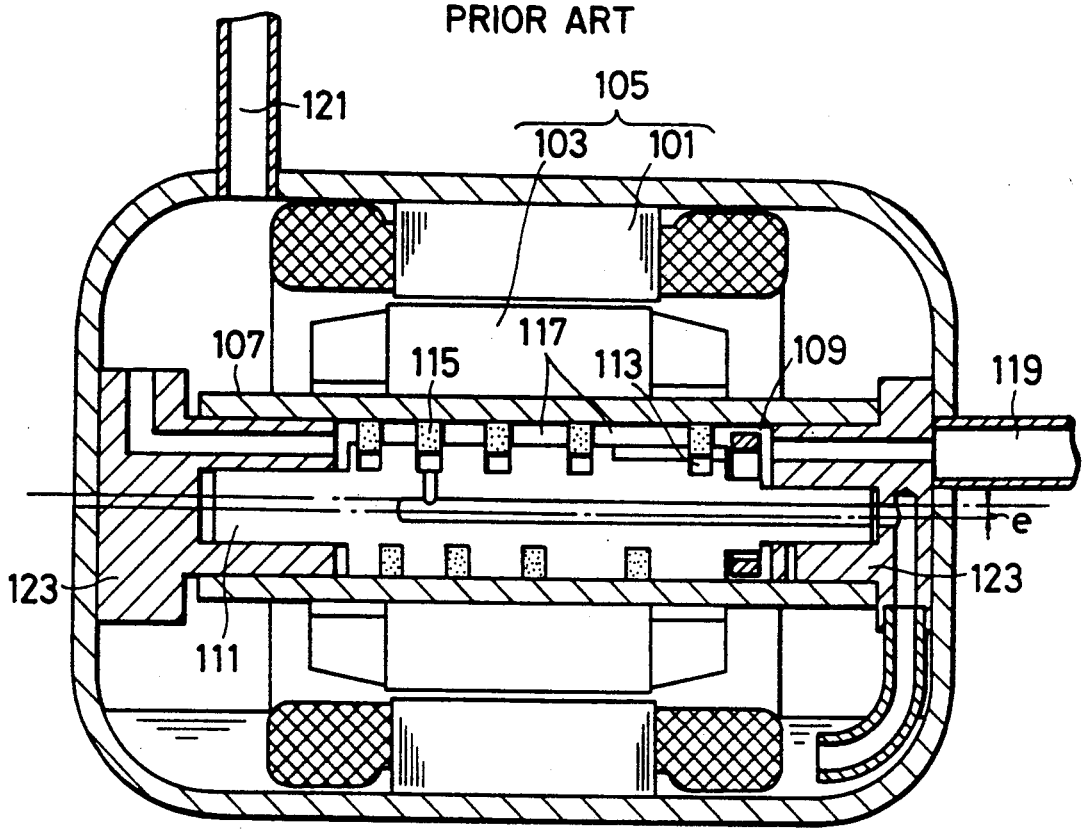
FIG. 1 PRIOR ART
FIG. 1 is a cross section of the entire body of a conventional helical blade type compressor.
Figure 2:
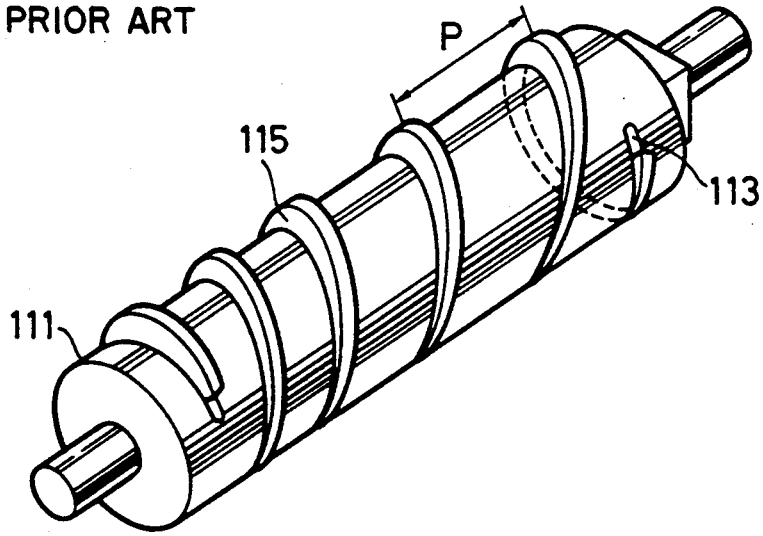
FIG. 2 PRIOR ART
FIG. 2 is a perspective view of a rotary rod shown in FIG. 1.
Figure 3:
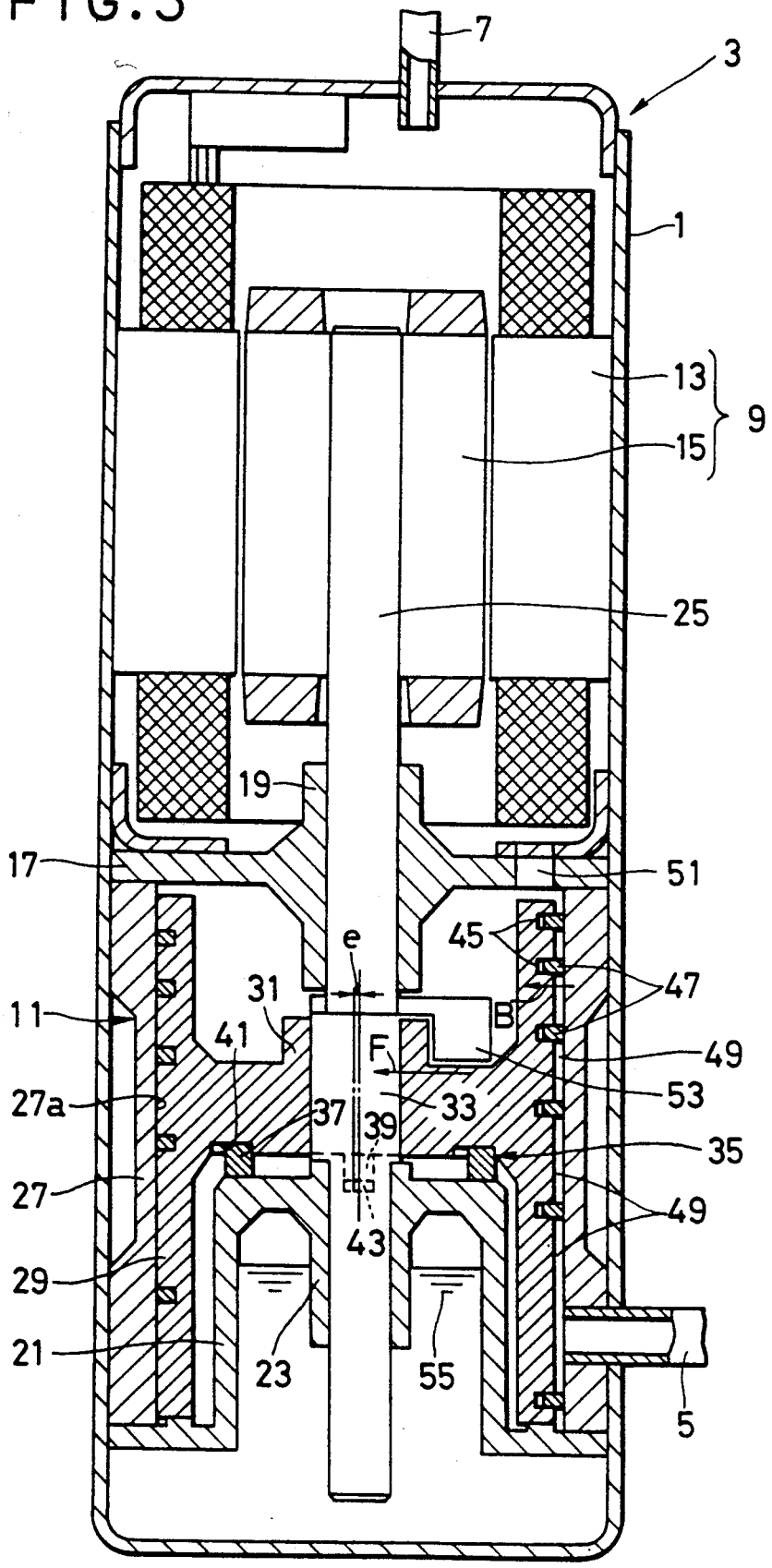
FIG. 3 is a cross section of the entire body of a fluid compressor as an embodiment of the present invention.

In FIG. 3, reference numeral 1 designates a vertical-type closed case of a closed fluid compressor used in the refrigeration cycle. At the bottom end of the closed case 1 there is arranged a suction pipe 5 to be used in the refrigeration cycle, while at the upper end thereof is provided a discharge pipe 7. Moreover, an electric driving unit 9, as a driving means, is disposed in the upper half portion of the closed case 1, while a compression unit 11 is arranged in the lower half portion thereof.

The electric driving unit 9 comprises a stator 13 fixed in the inner surface of the closed case 1 in an almost annular form, and an annular rotor 15 rotatably provided in the stator 13.

In the rotor 15 is fixed a main shaft 25 which is rotatably supported by a bearing section 10 of a first bearing member 17 and a bearing section 23 of a second bearing member 21, of both of the first and second bearing members 17, 21 being secured in the closed case. Moreover, the main shaft 25 extends up to the area in which the compression unit 11 is disposed.

On the other hand, the compression unit 11 includes a cylinder 27 and a rotary member 29, the cylinder 27 being fixed to the inner surface of the closed case 1.

The rotary member 29 is arranged along the axis of the cylinder 27 and formed in a cylindrical shape with an outer diameter less than the inner diameter of the cylinder 27, and has a boss 31 at the central portion thereof. The boss 31 of the rotary member 29 is fitted around an eccentric shaft portion 33 whose axis is spaced by a distance e from the central axis of the main shaft 25.

The eccentric shaft portion 33 is included in the main shaft 25 at almost the central portion of the cylinder 27, and is also supported by the bearing sections 19, 23 of the first and second bearing members 17, 21.

Moreover, by means of an Oldham coupling member 35, the rotary member 29 orbits together with the main shaft 25 while being in contact with the inner surface 27*a* of the cylinder 27 at a part of the outer surface thereof. Namely, the rotary member 29 orbits in contact with the fixed cylinder 27.

Figure 4:
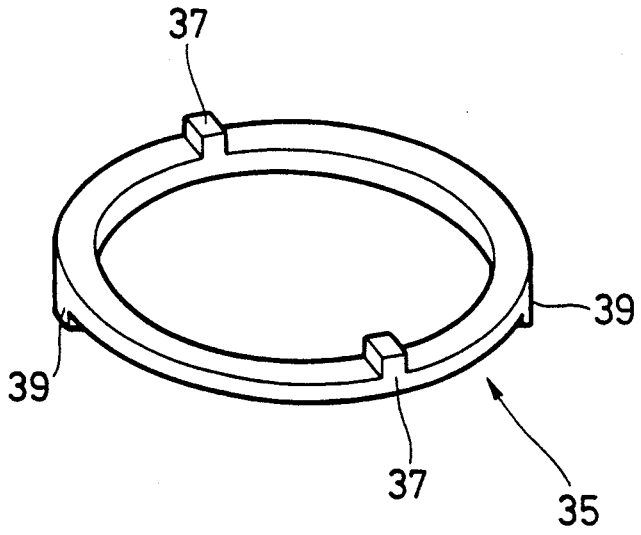
FIG. 4 is a perspective view of an Oldham coupling member shown in FIG. 3.

The Oldham coupling member 35 is a ring shape as shown in FIG. 4, and has a pair of projections 37, 37 on the top side thereof, and another pair of projections 39, 39 on the bottom side. Moreover, each upper projection 37 is shifted by 90° from each lower projection 39, and each upper projection 37 is engaged in each first groove 41 formed in the boss 31 of the rotary member 29. On the other hand, each lower projection 39 is engaged in each second groove 43 which is formed in the second bearing member 21 and shifted by 90° from each first groove 41.

Moreover, in the outer surface of the rotary member 29 there is formed a spiral groove 45 along the axis thereof, and the pitch of the groove 45 is so arranged as to be at a maximum at the portion nearest to the suction pipe 5, and a minimum at the portion nearest to the discharge pipe 7. Additionally in the spiral groove 45 there is fitted a blade 47 formed with an elastomeric material, such as synthetic resins, so as to enable the blade 47 to vertically move in the groove 45 by the elastic properties of the material. The length of the blade 47 is a little shorter than that of the spiral groove 45, and the width is almost the same as that of the spiral groove. Moreover, the thickness is smaller than the depth of the groove, therefore, the blade 47 can move radially (in a direction shown by an arrow B in FIG. 3) within the space defined between the bottom of the groove and the inner surface of the cylinder 27.

Figure 5A:
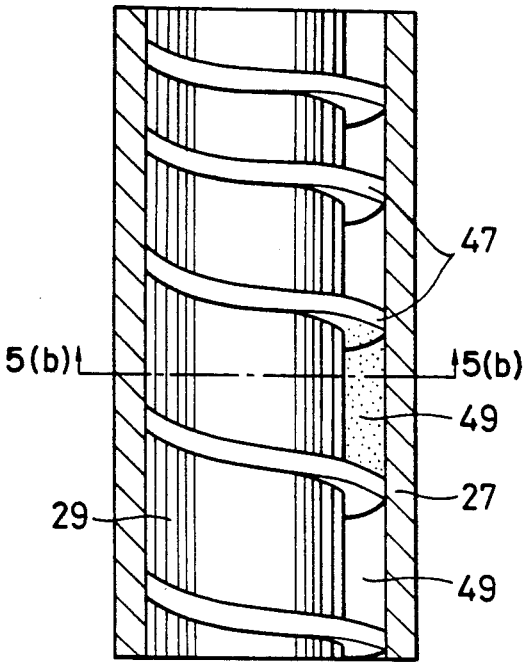
FIGS. 5*a*, 6*a*, 7*a*, 8*a* are schematic diagrams to respectively explain the operation of the fluid compressor shown in FIG. 3.
Figure 6A:
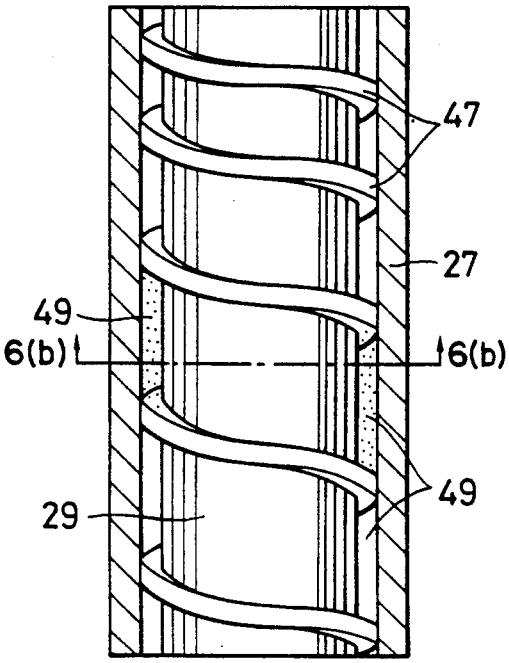
Figure 5B:
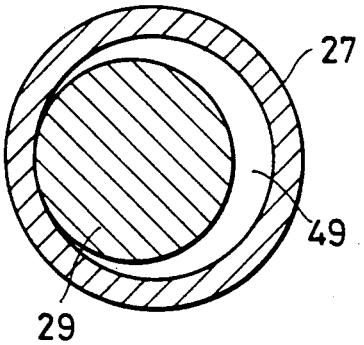
FIGS. 5*b*, 6*b*, 7*b*, 8*b* are cross sections respectively, taken along lines 5(*b*)—5(*b*), 6(*b*)—6(*b*), 7(*b*)—7(*b*) and 8(*b*)—8(*b*) in FIGS. 5*a*, 6*a*, 7*a*, 8*a*, respectively.
Figure 6B:
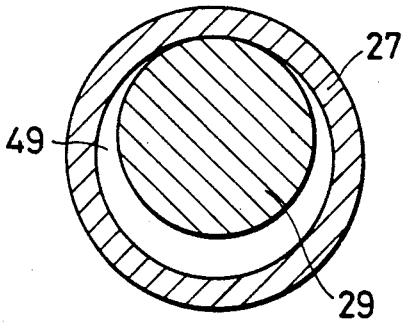
Figure 7:
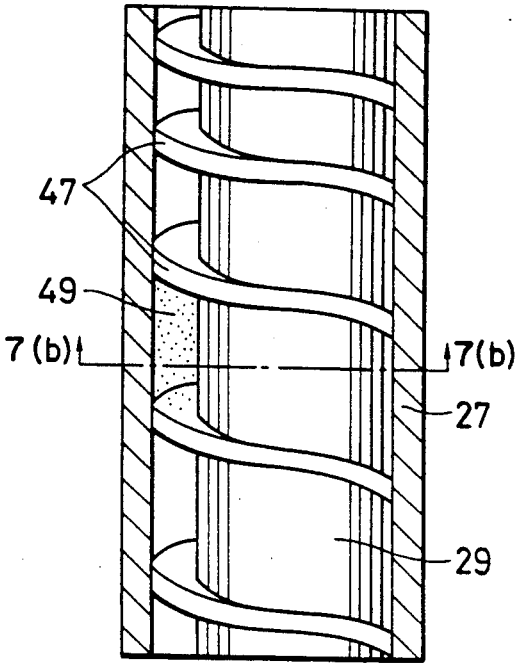
Figure 8:
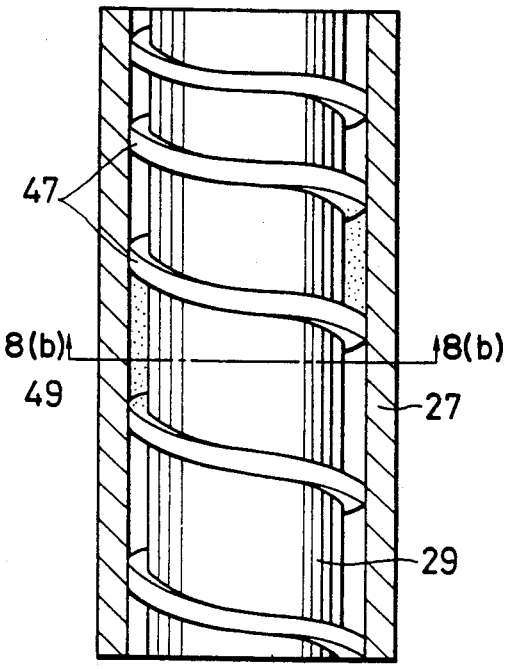
Figure 7:
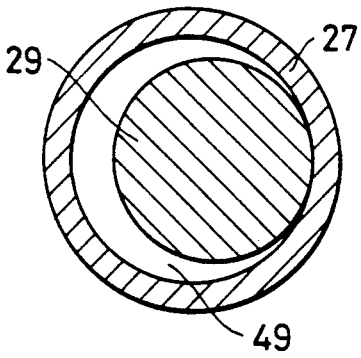
Figure 8:
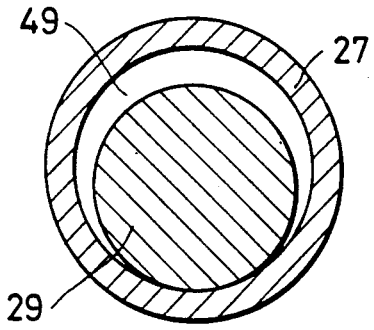

The outer surface of the blade 47 is partly in contact with the inner surface of the cylinder 27, so that the space defined between the inner surface of the cylinder 27 and the outer surface of the rotary member 29 is divided into a plurality of operation chambers 49 by the blade 47. Namely, each operation chamber is defined between each adjacent pair of contact portions of the blade 47 to the inner surface of the cylinder 47 as shown in FIG. 5*a*, and the cross section is in a shape of a crescent as shown in FIG. 5*b*.

The capacity of each operation chamber is the maximum at the portion the nearest to the suction pipe 5 (at the lowest operation chamber shown in FIG. 3), and becomes gradually smaller toward the portion nearest to the discharge pipe 7 (toward the top operation chamber shown in FIG. 3).

Moreover, the lowest or first operation chamber 49 on the inlet side is in communication with the suction pipe 5, and a refrigerant gas is continuously supplied thereto from the pipe 5. On the other hand, the top or last operation chamber 49 on the discharge side communicates with the discharge pipe 7 through an opening 51 formed through the first bearing member 17. Incidentially, in FIG. 3, reference numeral 53 designates a balance weight provided at the main shaft 25, and 55 shows lubricant oil to be supplied to the respective bearing sections 19, 23.

Next, the operation of the fluid compressor is explained.

First, electric power is supplied to the electric driving unit 9 so as to rotate the rotor 15 and the main shaft 25. Then, the rotation movement of the main shaft 25 results in the orbit movement of the rotary member 29 through the Oldham coupling member 35. As the result, a refrigerant gas supplied to the first operation chamber 49 on the inlet side is successively carried, while being compressed, toward the last operation chamber 49 on the discharge side through the respective chambers 49 provided therebetween, in such a manner as shown in FIGS. 5 to 8, and is then discharged from the discharge pipe 7.

In the above-mentioned operation, since the diameter of the cylinder 27 can be set so as to enlarge the capacity of the first chamber 49, the contact between the blade 7 and the inner surface of the cylinder 27 is so smooth that stable operation can be maintained for a long period of time. Moreover, during the compression of the refrigerant gas, the gas pressure acting on the cylinder 27 has no influence on the respective bearing sections 19, 23.

Besides, the force designated by an arrow F in FIG. 3, which is generated by the refrigerant gas during compression, is transmitted to the eccentric shaft 33 of the main shaft 25 through the boss 31. In this case, since the eccentric shaft 33 is positioned in an area where the gas force F is acting, the bending moment applied to the rotary member 29 can be suppressed at a relatively small value. Moreover, since the main shaft 25 is supported by the two bearing sections 19, 23, the bending moment to be applied to the main shaft 25 can be also suppressed, thereby obtaining a stable rotational movement thereof.

Incidentally, in this embodiment, though the present invention is used for a vertical type fluid compressor, it can be also used for the horizontal type or vacuum pumps, As stated above, according to the present invention, it becomes possible to enlarge the diameter of the cylinder by fixing it to the case and orbiting the rotor only. Thus, the operational efficiency of the system can be greatly improved by enlarging the first operation chamber the nearest to the inlet end without twisting the blade excessively.

Moreover, since the blade can be flexibly fitted in the spiral groove, it becomes possible to prevent concentration of load to a specific portion of the blade, so that stable operation of the system can be maintained for a long period of time.

Besides, since the system structure is so constructed so as to suppress the load to be imposed on the bearing sections, the rotary system can be operated more stably and smoothly than the conventional systems.

Various modifications will become possible for those skilled in the art after receiving the teachings of the present disclosure without departing from the scope thereof.

What is claimed is:

1. A fluid compressor having a spiral blade, comprising:

a closed case having inlet and outlet ends;

a cylinder fixed within the closed case;

a main shaft having a central axis and passing through the cylinder;

an eccentric shaft disposed around the main shaft;

a rotary member having a spiral groove formed in its outer surface, and being fit around the eccentric shaft, the rotary member orbiting relative to the cylinder about an axis which is different from the central axis while partly contacting the inner surface of the cylinder; and means for preventing rotation of the rotary member thereby allowing it to orbit;

wherein the spiral blade is movably disposed in the spiral groove and has an outer surface for contacting the inner surface of the cylinder, thereby dividing a space defined between the inner surface of the cylinder and the outer surface of the rotary member into a plurality of operation chambers.

2. The fluid compressor according to claim 1, wherein during an orbit movement of the rotary member relative to the fixed cylinder, a fluid supplied from the inlet is compressed by means of the plurality of operation chambers and discharged from the outlet.

3. The fluid compressor according to claim 1, further comprising:

driving means for rotating the main shaft.

4. A fluid compressor having a spiral blade, comprising:

(a) a closed case having an inlet for a fluid at one end thereof and an outlet for a fluid at the other end thereof;

(b) a cylinder having a central axis and being fixed in the closed case;

(c) a rotary member which orbits within and relative to the fixed cylinder; and (d) means for preventing rotation of the rotary member thereby allowing it to orbit;

wherein the rotary member includes compression means for compressing a fluid supplied into the closed case from the inlet thereof during an orbit movement of the rotary member relative to the cylinder, and for discharging the fluid outside of the closed case via the outlet of the closed case, the compression means including a spiral groove which is formed in the outer surface of the rotary member and has a pitch being gradually narrower toward the outlet of the closed case from the inlet thereof; and a spiral blade which is movably fitted in the groove and has an outer surface for contacting with the inner surface of the cylinder so as to divide the space defined between the inner surface of the cylinder and the outer surface of the rotary member into a plurality of operation chambers.

5. The fluid compressor according to claim 4, further comprising:

driving means for driving the rotary member.

* * * * *